US011874079B2

(12) United States Patent
Naylor

(10) Patent No.: US 11,874,079 B2
(45) Date of Patent: Jan. 16, 2024

(54) FIREARM SUPPORT

(71) Applicant: Jeffery D. Naylor, Penrose, CO (US)

(72) Inventor: Jeffery D. Naylor, Penrose, CO (US)

( * ) Notice: Subject to any disclaimer, the term of this patent is extended or adjusted under 35 U.S.C. 154(b) by 0 days.

(21) Appl. No.: 17/696,601

(22) Filed: Mar. 16, 2022

(65) Prior Publication Data

US 2022/0364815 A1 Nov. 17, 2022

Related U.S. Application Data

(60) Provisional application No. 63/162,614, filed on Mar. 18, 2021.

(51) Int. Cl.
*F41A 23/02* (2006.01)

(52) U.S. Cl.
CPC ..... *F41A 23/02* (2013.01)

(58) Field of Classification Search
CPC ..... F41A 23/02
See application file for complete search history.

(56) References Cited

U.S. PATENT DOCUMENTS 465,088 A * 12/1891 Patchen ..... F41G 11/007 42/125
2,806,288 A * 9/1957 Sarvis ..... F41G 1/28 24/535
3,827,172 A * 8/1974 Howe ..... F41A 23/00 42/94
3,834,035 A * 9/1974 Merrill ..... F41G 1/08 42/133
4,026,057 A 5/1977 Cady
4,317,304 A * 3/1982 Bass ..... F41G 11/001 42/125
4,972,619 A * 11/1990 Eckert ..... F41A 23/16 89/37.04
5,046,277 A * 9/1991 Sanders ..... F41G 1/16 362/110
5,081,783 A 1/1992 Jarvis
5,208,989 A * 5/1993 Sanders ..... F41G 1/16 42/145
5,274,941 A * 1/1994 Moore ..... F41G 11/005 42/126
5,333,829 A 8/1994 Bell et al.
5,400,539 A * 3/1995 Moore ..... F41G 11/005 42/126
5,617,666 A * 4/1997 Scott ..... F41A 23/16 89/37.04
5,644,862 A * 7/1997 Folmer ..... F41A 23/18 42/94
5,845,427 A 12/1998 Taylor
(Continued)

*Primary Examiner* — Michelle Clement
(74) *Attorney, Agent, or Firm* — MP Patents, LLC

(57) ABSTRACT

A firearm rest includes a mount, a rider, a retainer, a knob and a bolt. The mount has a platform configured for coupling with a firearm stock and a pedestal extending from the platform and including a threaded longitudinal bore and an enlargement distal from the platform. The rider has a front, a base and a top with a socket configured to slidingly engage the enlargement of the pedestal parallel with the longitudinal bore. The retainer is coupled with the front of the rider and has a cut-out. The knob has a groove configured for mating with the cut-out. The bolt has a first end received in the knob and a second end received in the longitudinal bore of the mount.

20 Claims, 5 Drawing Sheets

(56) References Cited

U.S. PATENT DOCUMENTS

| | | | | |
|---|---|---|---|---|
| 5,937,561 | A * | 8/1999 | Abernethy | F41A 23/16 89/37.04 |
| 6,112,422 | A * | 9/2000 | Laiche, Jr. | F41G 1/10 42/137 |
| 6,158,159 | A | 12/2000 | Zekas | |
| 6,305,116 | B1 | 10/2001 | Parker | |
| 6,662,486 | B2 * | 12/2003 | Komberger | F41G 11/007 42/138 |
| 7,647,720 | B1 * | 1/2010 | Vendetti | F41G 1/28 42/126 |
| 8,240,075 | B1 * | 8/2012 | Mullin | F41G 11/003 42/122 |
| 8,763,296 | B1 * | 7/2014 | Chvala | F41C 23/14 42/73 |
| 8,763,299 | B2 * | 7/2014 | Clifton | F41G 11/003 42/125 |
| 8,857,094 | B2 * | 10/2014 | Michel | F41C 23/10 42/71.01 |
| 8,955,245 | B2 * | 2/2015 | Chvala | F41C 23/14 42/1.06 |
| 9,459,075 | B1 * | 10/2016 | Hatcher | F41G 1/48 |
| 9,546,839 | B1 | 1/2017 | Hancosky | |
| D894,318 | S | 8/2020 | Pobutkiewicz | |
| D894,319 | S | 8/2020 | Pobutkiewicz | |
| D907,159 | S | 1/2021 | Pobutkiewicz | |
| 2008/0047188 | A1 | 2/2008 | Lindstrom | |
| 2013/0086835 | A1 | 4/2013 | Minneman | |
| 2016/0010944 | A1 * | 1/2016 | Downey | F41C 23/14 42/74 |

* cited by examiner

FIREARM SUPPORT

CROSS REFERENCE TO RELATED APPLICATIONS

This application claims the priority benefit of U.S. Provisional Application No. 63/162,614, filed 2021 Mar. 18 which is incorporated herein by reference in its entirety.

TECHNICAL FIELD

The disclosure pertains to elevating rifle stocks during use.

SUMMARY

The disclosure describes a rest for a firearm. The rest includes a mount, a rider, a retainer, a knob and a bolt. The mount has a platform configured for coupling with a firearm stock and a pedestal extending from the platform and including a threaded longitudinal bore and an enlargement distal from the platform. The rider has a front, a base and a top with a socket configured to slidingly engage the enlargement of the pedestal parallel with the longitudinal bore. The retainer is coupled with the front of the rider and has a cut-out. The knob has a groove configured for mating with the cut-out. The bolt has a first end received in the knob and a second end received in the longitudinal bore of the mount.

The disclosure also describes a firearm rest. The firearm rest includes a rider, a mount having a length and a threaded shaft. The rider has a front, a base, a top inclined relative to the base and a channel provided to the top. The mount, configured for sliding engagement with the channel, includes a platform configured for coupling with a firearm stock and a threaded longitudinal bore distal from the platform. The threaded shaft is configured to rotate relative to the longitudinal bore to slide the mount relative to the rider.

The disclosure also describes a support for a firearm stock. The support includes a mount, a rider and a rotatable knob. The mount has a platform configured for coupling with a firearm stock. The rider is configured to slidably interlock with a portion of the mount. The rotatable knob is provided to the mount and configured to convert rotation into sliding of the mount relative to the rider and elevating of the mount above a surface supporting the rider.

BRIEF DESCRIPTION OF THE FIGURES

The summary above, as well as the following detailed description of illustrative embodiments, is better understood when read in conjunction with the appended drawings. For the purpose of illustrating the disclosure, example constructions are shown in the drawings. However, the disclosure is not limited to specific methods and instrumentalities disclosed herein. Moreover, those having ordinary skill in the art will understand that the drawings are not to scale. Wherever possible, like elements have been indicated by identical numbers.

Embodiments of the disclosure will now be described, by way of example only, with reference to the following diagrams wherein.

DETAILED DESCRIPTION

Figure 1:
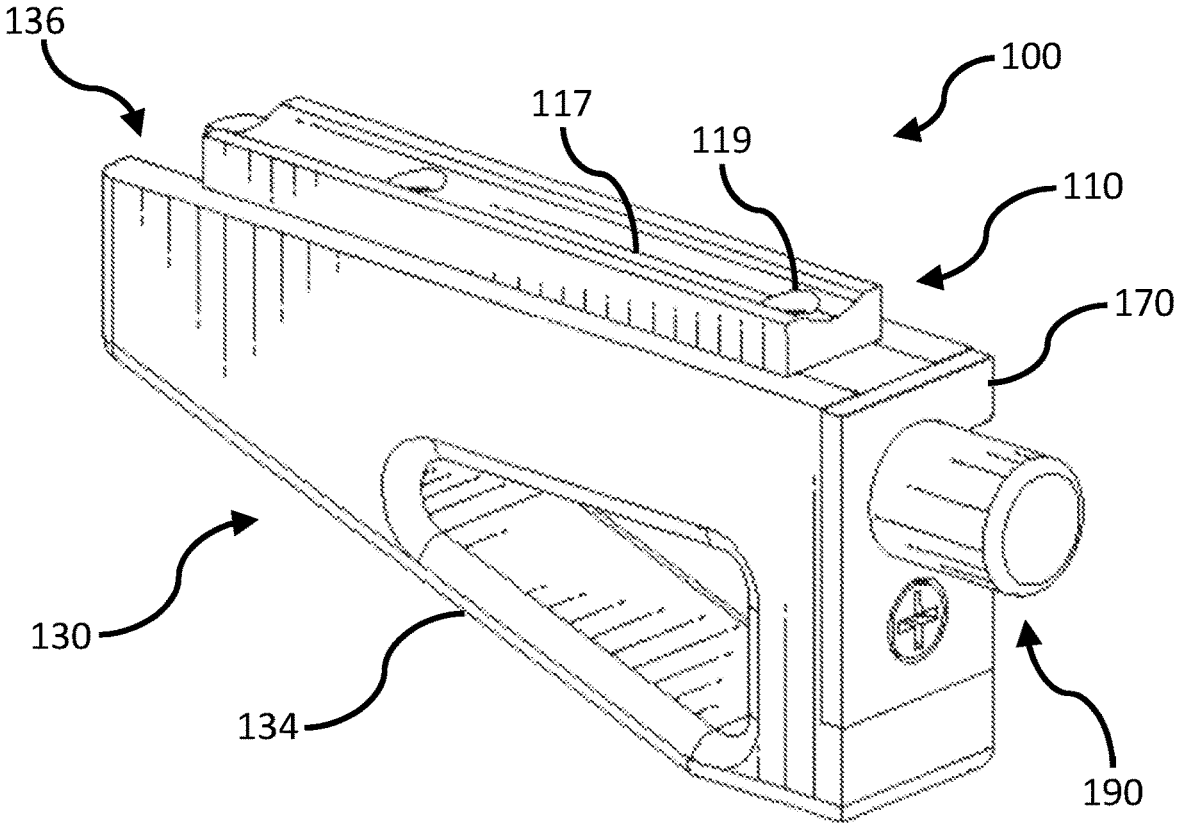
FIG. 1 illustrates a perspective view of an example firearm support in accordance with the disclosure.
Figure 2:
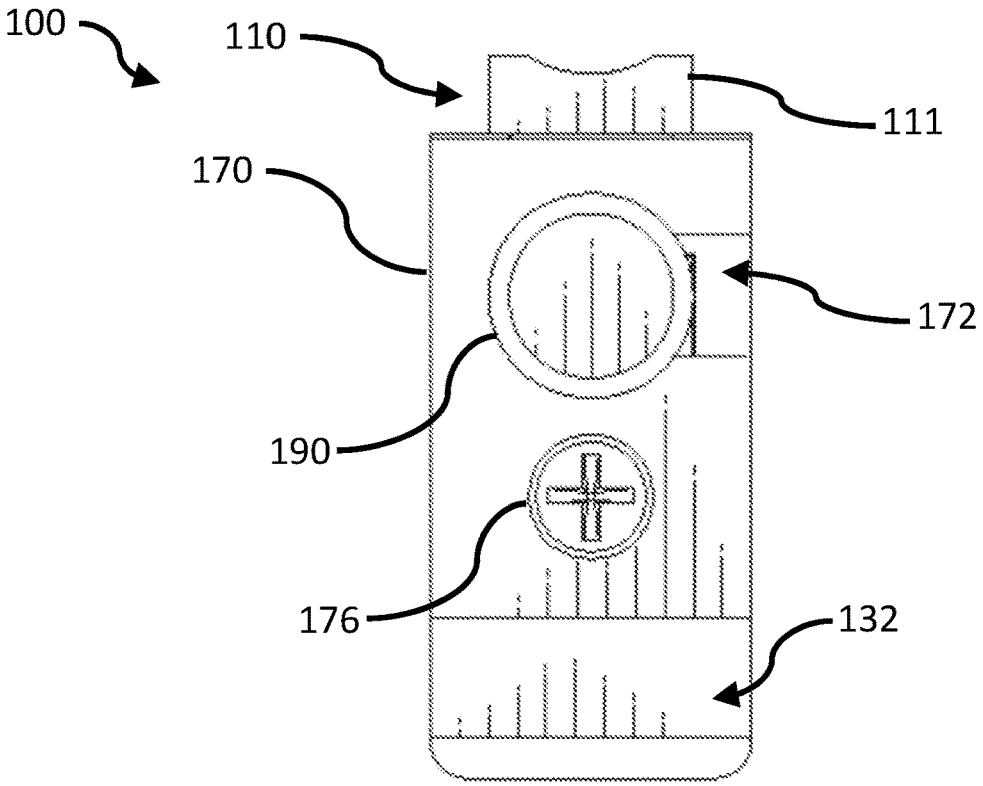
FIG. 2 illustrates a front view of the example firearm support of FIG. 1.
Figure 3:
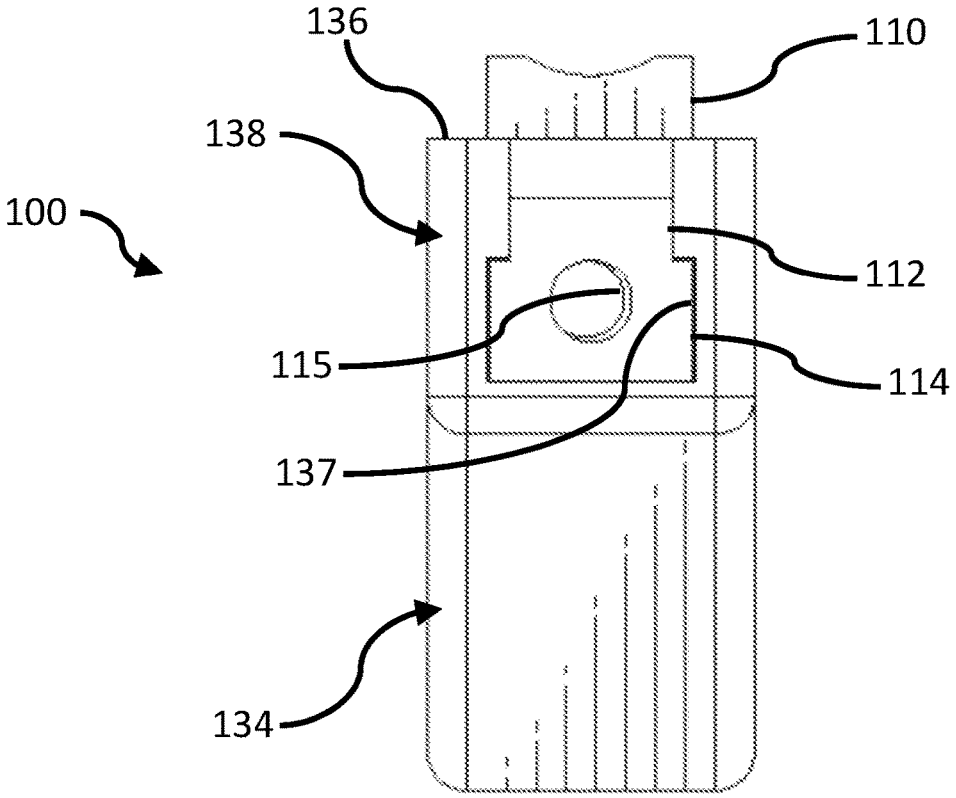
FIG. 3 illustrates a rear view of the example firearm support of FIGS. 1 & 2.
Figure 4:
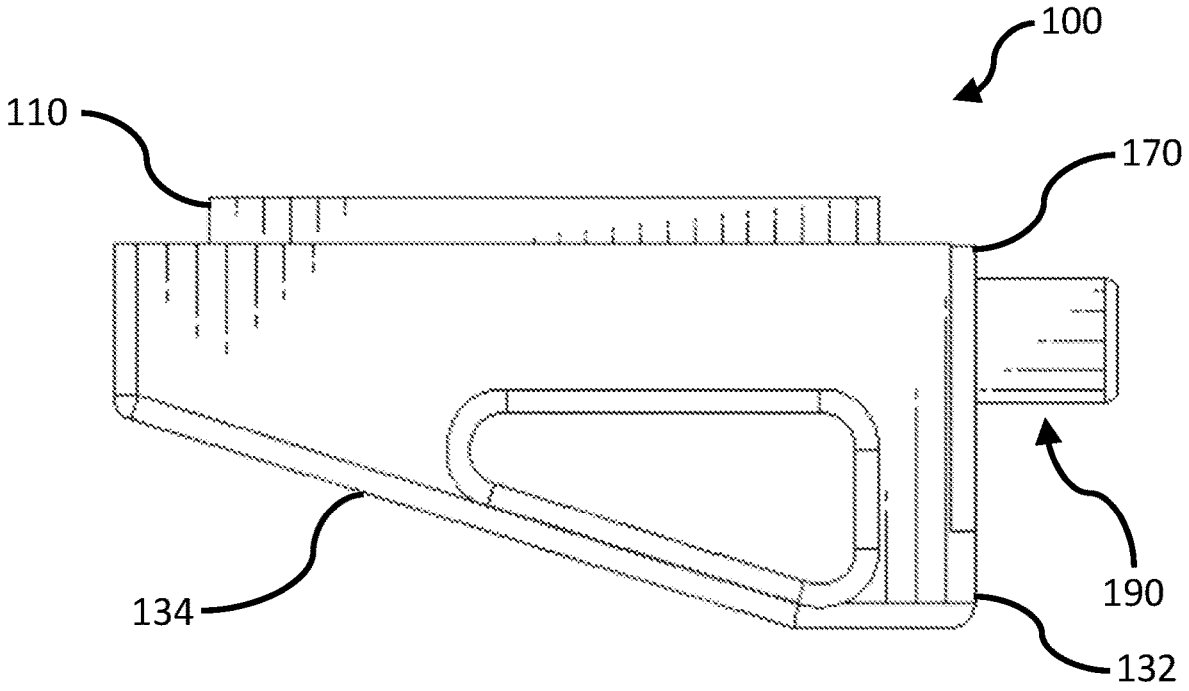
FIG. 4 illustrates a left side view of the example firearm support of FIGS. 1-3.

The following detailed description illustrates embodiments of the disclosure and manners by which they can be implemented. Although the preferred mode of carrying out disclosed apparatus and methods has been described, those of ordinary skill in the art would recognize that other embodiments for carrying out or practicing disclosed apparatus and methods are also possible.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

Traditional style rifle stocks with their angled butt stocks make it difficult to maintain elevation when firing. Known bag riders are fixed with no provision for adjustment. No bag rider presently provides elevation adjustment for a traditional style stock. Thus, adjusting elevation has required manipulating a sand bag, or other type of rear support, forward or backward and/or squeezing it to try to get the elevation desired on target.

Embodiments of the disclosure provide firearm supports with elevation adjustment under the back of a traditional style rifle stock and substantially eliminate, or at least partially address, problems in the prior art, enabling raising and lowering the back of the rifle stock with rotational motion.

Additional aspects, advantages, features and objects of the disclosure will be made apparent from the drawings and the detailed description of the illustrative embodiments construed in conjunction with the appended claims that follow. It will be appreciated that described features are susceptible to being combined in various combinations without departing from the scope of the disclosure as defined by the appended claims.

FIGS. 1-6 illustrate an example firearm support 100 which may be employed to support a firearm stock, for example, as a firearm rest. Firearm support 100 includes a mount 110, a rider 130, a retainer 170, a rotatable knob 190 and a threaded shaft or bolt 150.

Figure 6:
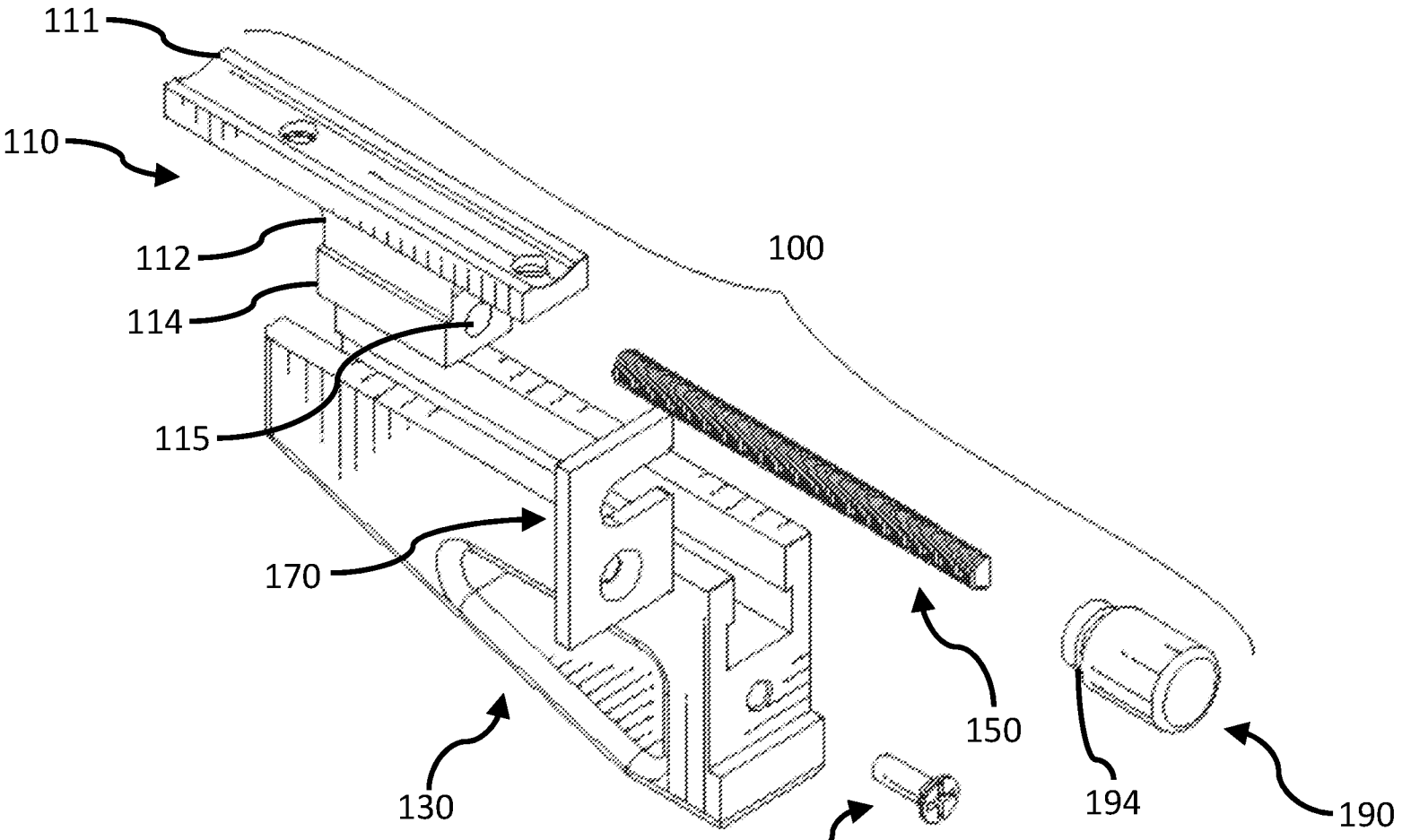
FIG. 6 illustrates an exploded view of the example firearm support of FIGS. 1-5.

Considering FIG. 6, mount 110 has a platform 111 configured for coupling with a firearm stock and a pedestal or web 112 extending from platform 111 and including a threaded longitudinal bore 115 and an enlargement 114, both distal from platform 111. In an example, enlargement 114 may include one or more flanges projecting in a transverse direction from web 112.

Platform 111 may further include a cylindrical concavity 117 (FIGS. 1 & 5) directed along its length and configured to receive or otherwise cooperate with a rounded edge of a firearm stock for coupling thereto. For example, mount 110 is configured to cradle the firearm stock with a curvature defined by a radius rotated about an axis parallel with the platform length and/or the threaded longitudinal bore. Platform 111 may, for example, contact a portion of a firearm near the sling stud, between the butt and the grip, opposite the cheek rest.

Mount 110 may further include one or more holes 119 in platform 111 configured for receiving one or more fasteners for coupling mount 110 to a firearm stock. While shown by way of example as including two holes 119, mount 110 may include any number of holes sufficient to enable coupling to a firearm with a number of fasteners. In an example, mount 110 may be coupled with a firearm stock by employing a rear sling swivel stud. In another example, mount 110 may be coupled with a firearm stock by employing a wood screw.

Features of mount 110 may take any of a variety of dimensions suitable for coupling with a firearm to adjustably support the firearm. In an example, platform 111 is 3.5" along its length and 0.625" wide with a total thickness of 0.25". In an example, web 112 and enlargement 114, together are 0.75" high. In an example, web 112, enlargement 114 and longitudinal bore 115 are each 1.25" long. In an example, enlargement 114 is 0.625" wide while web 112 is 0.5" wide. The radius of curvature defining cylindrical concavity 117 may, for example, be 0.375" and penetrate platform 111 by 0.06". In an example, longitudinal bore 115 is of 0.25" diameter and mount holes 119 are 0.25" in diameter. Fillets may be provided to eliminate stress concentrations at front and rear joins of web 112 with platform 111. In an example, the fillet radii of curvature are 0.188".

A rider 130 (FIGS. 1, 3 & 4) has a base 134, a top 136, front 132 spacing apart base 134 and top 136 as well as a rear 138 similarly spacing apart base 134 and top 136. In an example, an angle measured between top 136 and the 132 is about 90 degrees, while an angle measured between base 134 and top 136 may be oblique and an angle measured between base 134 and front 132 may be oblique. In this way, top 136 is inclined relative to base 134. In a further example, a sum of angles measured between top 136 and base 134, between base 134 and front 132 and between front 132 and top 136 may be 180 degrees or less while a sum of an angle measured between top 136 and base 134 and an angle measured between base 134 and front 132 may be 90 degrees or less.

Top 136 is provided with a socket 137 configured to slidingly interlock with or otherwise engage enlargement 114 parallel with longitudinal bore 115. In an example, socket 137 takes the form of a channel. Being provided to or through top 136 of rider 130, channel 137 may also be inclined relative to base 134. In an example, an angle measured between the bottom, interior surface of channel 137 is approximately equal to the angle between top 136 and base 134.

Channel 137 may further include grooves (FIG. 3) provided in the opposing walls and configured to mesh, mate or otherwise cooperate with the flanges at enlargement 114 for sliding engagement with the channel. With this arrangement, mount 110 is effectively coupled to rider 130 through one or more tongue-and-groove joints or a type of sliding dove-tail or sliding T-slot joint.

A hole may be provided to rear 138 of rider 130 to enable fastening of a retainer to rider 130 by way of a fastener received in the hole and a hole of the retainer. Firearm support 100 may further include a sling swivel stud extending from rider front 132.

Features of rider 130 may take any of a variety of shapes and dimensions suitable for cooperating with mount 110. In an example, an angle between top 136 and base 134 is 17.5 degrees. In an example, the width of rider 130 is 1.00" while the height is 2.00" and the length is 4.50". In an example, front 132 is 0.88" high. In an example, top 136 is 4.375" long. In an example, channel 137 is 4.375" long with a total depth of 0.75". In an example, the grooves provided to channel 137 are 0.635" deep and 0.38" high while extending the length of the channel. In an example, a retainer riser of 0.125" is provided to rear 138.

In an example, rider 130 may be provided with an opening through the sides which may take any of a variety of shapes including but not limited to triangular with a first leg 1.638" long at a 90-degree angle with a second leg and at a 17.5-degree angle with a hypotenuse.

Mount 110 and rider 130 may be formed from any of a variety of lightweight, durable, corrosion-resistant materials including but not limited to aluminum, hard coat anodize, teflon impregnated anodize, plastics such as Delrin and combinations thereof.

Retainer 170 (FIGS. 2 & 6) has a slot, notch or cut-out 172 configured to receive a portion of knob 190 to thereby retain or prohibit translation of threaded shaft 150 relative to rider 130 when retainer 170 is selectively coupled with front 132. In an example, retainer 170 is provided as a polygonal plate having cut-out 172 provided through at least one side and a fastener hole through its face. The fastener hole is sized, shaped and/or configured to at least partially align and/or cooperate with a hole provided to rear 138 of rider 130. In a further example, the polygonal plate is a rectangular plate.

Retainer 170 may take any of a variety of shapes and dimensions suitable for functionally matching rear dimensions of rider 130 and channel 137. In particular, a fastener hole of retainer 170 may match up or align with the retainer fastener hole of rider 130 and cut-out 172 of retainer 170 may match up or align with longitudinal threaded bore 115 of mount 110. In an example, retainer 170 is 1.49" high, 1.0" wide and 0.120" thick. In an example, cut-out 172 extends 0.89" in from the side/edge and ends in a hole of 0.390" diameter. In an example, the hole for the retainer fastener measures 0.22" in diameter.

In an example, a retainer fastener hole of diameter 0.24" is provided to the rider 130 at rear 138. While any of a variety of fasteners may be used to fasten retainer 170 to rider 130, in an example the fastener is a threaded fastener such as a screw or bolt.

Retainer 170 may be formed from any of a variety of lightweight, durable, corrosion-resistant materials including but not limited to stainless steel, brass and combinations thereof.

Figure 5:
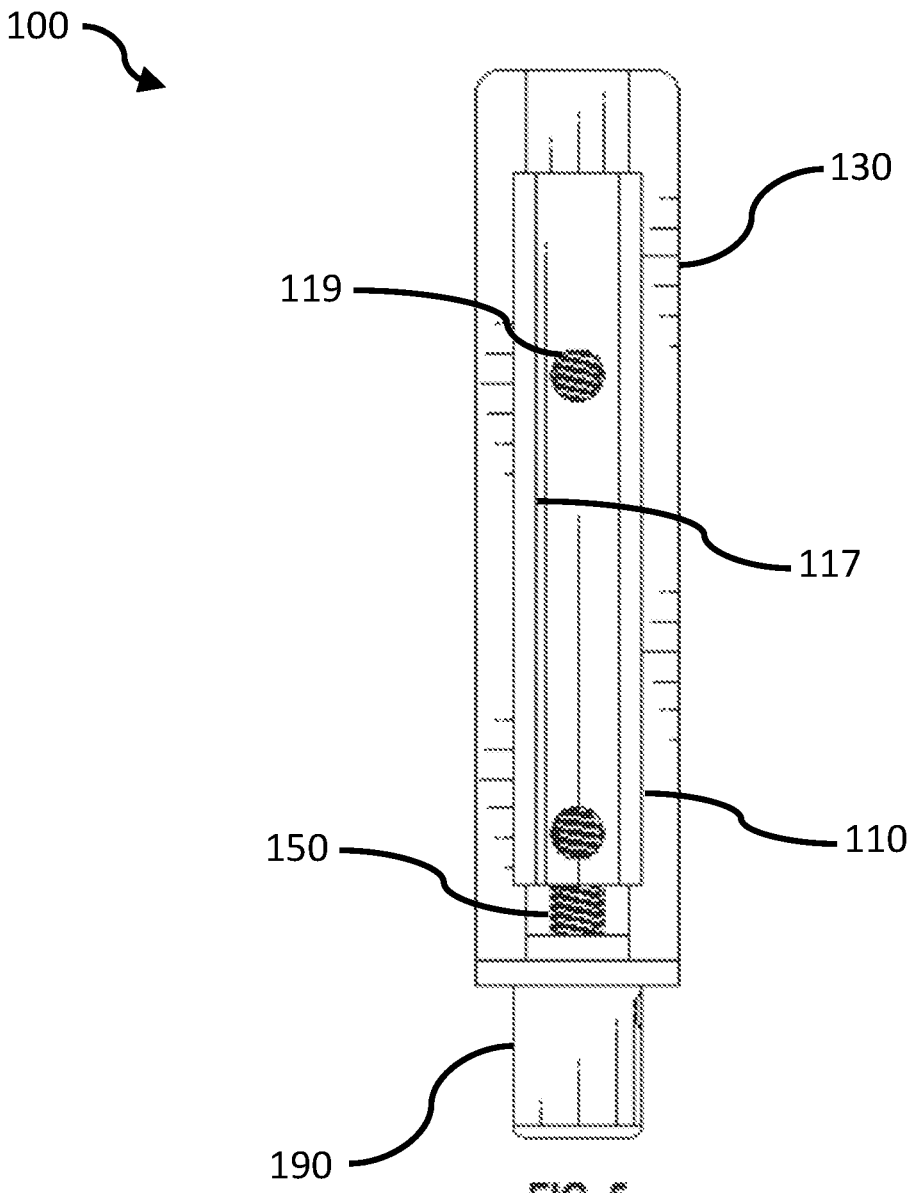
FIG. 5 illustrates a top view of the example firearm support of FIGS. 1-4.

Referring to FIGS. 1, 5 & 6, threaded shaft 150 has a first end fixedly received by rotatable knob 190 and a second end receivable in threaded longitudinal bore 115 of mount 110. Threaded shaft 150 may be received in a faceted cavity of knob 190 which prevents relative rotation between threaded shaft 1250 and knob 190. By rotation of knob 190, threaded shaft 150 is configured to rotate within threaded longitudinal bore 115 to thereby advance or withdraw from mount 110. With cut-out 172 engaging a groove 194 provided to an exterior of knob 190, rotating knob 190 may cause groove 194 to rotate within cut-out 172 while retainer 170 fixes knob 190 and threaded shaft 150 against translation relative to rider 130. As a result, translation is imparted to mount 110 relative to rider 130.

Rotating knob 190, and thereby threaded shaft 150, in a first direction may cause threaded shaft 150 to advance within threaded longitudinal bore 115 pulling mount 110 to advance it or move it forward along rider 130. Since top 136 of rider 130 provides an inclined plane, moving mount 110 forward on rider 130 will increase the elevation of the stock of a firearm supported by mount 110. Rotating knob 190, and thereby threaded shaft 150, in a second, opposite direction may cause threaded shaft 150 to withdraw from threaded longitudinal bore 115 pushing mount 110 to retract it or move it backward along channel 137 of rider 130. Again, since top 136 of rider 130 provides an inclined plane, moving mount 110 backward will decrease the elevation of the stock of the firearm.

In an example, threaded shaft 150 is 0.25" in diameter and 3.50" long. In an example, knob 190 is 1.00" in total length, includes a 0.130" wide groove 194 of 0.625" depth located 0.125" from the rear face of the knob. Internal threads provided to longitudinal bore 115 and external threads provided to threaded shaft 150 may be provided in any pitch or type suitable to offer continuous adjustment of the relative positions of mount 110 and rider 130. A smaller thread pitch may be used for finer adjustments while a larger thread pitch may be used for coarse adjustments. Knob 190 may further include a roughened exterior surface to facilitate gripping and rotating thereof. In an example, the roughened exterior surface includes knurling.

Threaded shaft 150 may be manufactured from any of a variety of lightweight, durable, corrosion-resistant materials including but not limited to stainless steel.

Figure 7:
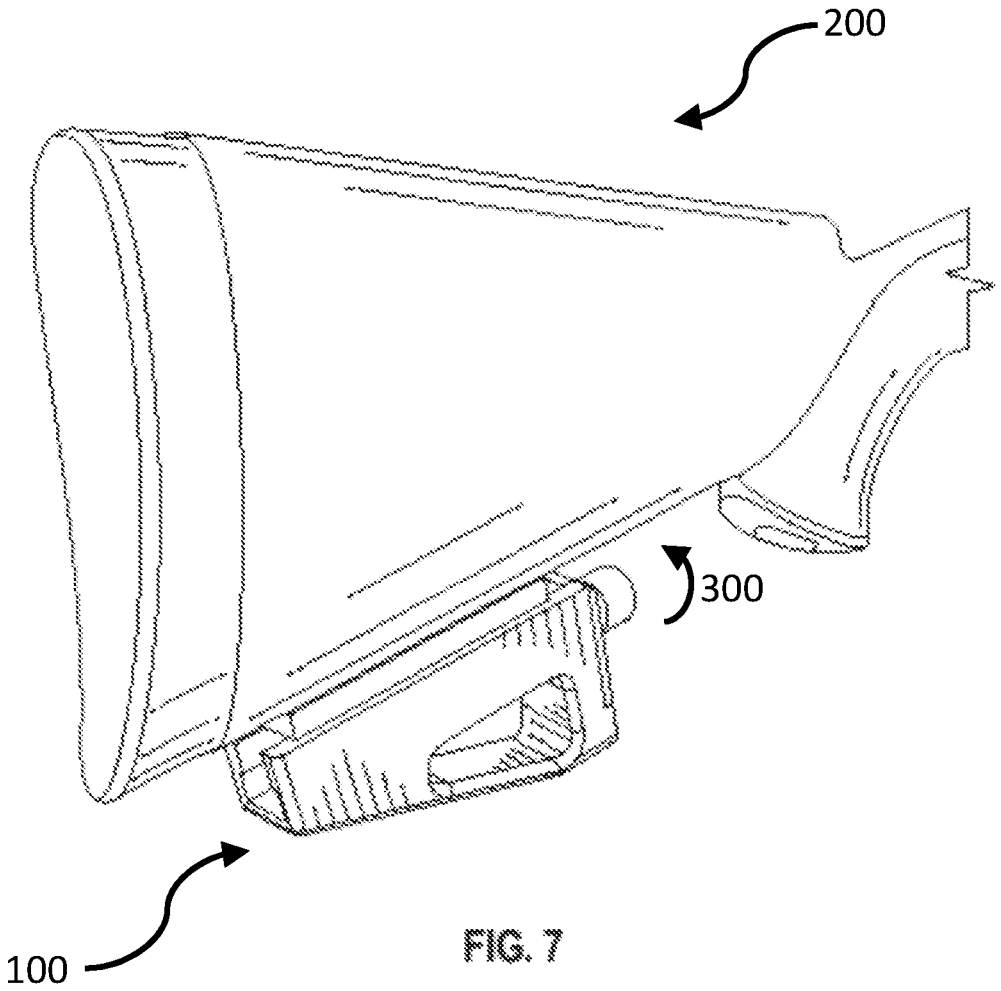
FIG. 7 illustrates a perspective view of an example firearm supported by an example firearm support.

A method for supporting a firearm stock includes, to a firearm stock, coupling a mount having a platform and a web extending from the platform and including a threaded longitudinal bore and an enlargement distal from the platform. Parallel with the longitudinal bore, the enlargement is slidingly engaged with a socket in a top of a rider. With a knob at its first end, a bolt is threaded in the longitudinal bore of the mount. A retainer is provided to a front of the rider such that a cut-out engages a groove of the knob. FIG. 7 illustrates a perspective view of an example firearm supported by an example firearm support.

When a user desires to increase the elevation of the firearm stock, the method will continue with rotating the knob clockwise in accordance with the rotational arrow 300 in FIG. 7 to advance the bolt within the threaded longitudinal bore and advance the rider along the enlargement of the pedestal.

When a user desires to decrease the elevation of the firearm stock, the method will continue with rotating the knob counter-clockwise to withdraw the bolt from the threaded longitudinal bore and retract the rider along the enlargement.

The actions described above are only illustrative and other alternatives can also be provided where one or more actions are added, one or more actions are removed, or one or more actions are provided in a different sequence without departing from the scope of the claims herein. It is to be noted that rotating the knob and thereby, the threaded shaft, results in a relative translation between the mount and the rider. Thus, it could be said either that the mount translates relative the rider or that the rider translates relative to the mount depending on which features are held fixed. In use, with the rider fixedly supported by a bag or other support object or surface, the mount and any firearm coupled thereto will translate and elevate relative to the rider. In other cases, such as just prior to use with the rider fixedly supported, rotation of the knob and threaded shaft may be considered to translate the rider relative to the mount and any firearm coupled therewith.

Embodiments of the disclosure are susceptible to being used for various purposes, including, though not limited to, enabling users to make elevation adjustments to the majority of rifle stock designs while providing the needed support for the rear of the rifle. A flat base of the rider may also provide a solid platform for a rifle to recoil straight back.

Modifications to embodiments of the disclosure described in the foregoing are possible without departing from the scope of the disclosure as defined by the accompanying claims. Expressions such as "including", "comprising", "incorporating", "consisting of", "have", "is" used to describe and claim disclosed features are intended to be construed in a non-exclusive manner, namely allowing for items, components or elements not explicitly described also to be present. Reference to the singular is also to be construed to relate to the plural.

What is claimed is:

1. A firearm rest, comprising:

a rider having a front, a base, a top inclined relative to the base and a channel provided to the top;

configured for engaging the rider in a sliding T-slot joint, a mount with a length and including:

a platform configured for coupling with a firearm stock; and a threaded longitudinal bore distal from the platform; and a threaded shaft configured to rotate relative to the longitudinal bore to slide the mount relative to the rider.

2. The firearm rest as set forth in claim 1, wherein the mount further comprises a web extending from the platform and at least one flange distal from the platform which is configured for the sliding engagement with the channel.

3. The firearm rest as set forth in claim 1, further comprising a plate configured for coupling with the front of the rider to prohibit translation of the threaded shaft relative to the rider.

4. The firearm rest as set forth in claim 1, further comprising a polygonal retainer configured for coupling with the front of the rider and having a cut-out through at least one side.

5. The firearm rest as set forth in claim 4, further comprising a knob provided to a first end of the threaded shaft and having a groove configured for mating with the retainer.

6. The firearm rest as set forth in claim 1, wherein the mount is configured to cradle the firearm stock with a curvature defined by a radius rotated about an axis parallel with the threaded longitudinal bore.

7. The firearm rest as set forth in claim 1, wherein an angle measured between the base and the front is oblique.

8. The firearm rest as set forth in claim 1, wherein a sum of an angle measured between the top and the base and an angle measured between the base and the front is 90 degrees or less.

9. The firearm rest as set forth in claim 1, wherein rotating the threaded shaft in a first direction causes the threaded shaft to advance within the threaded longitudinal bore and the rider to slide along the mount in a first direction while rotating the knob in a second, opposite direction causes the threaded shaft to withdraw from the threaded longitudinal bore and the rider to slide in a second, opposite direction along the mount.

10. The firearm rest as set forth in claim 1, wherein the platform further includes a cylindrical concavity configured to cooperate with a rounded edge of a firearm stock.

11. A firearm rest, comprising:

a rider having a front, a base, a top inclined relative to the base and a channel provided to the top;

in sliding engagement with the rider, a mount with a length and including:

a platform configured for coupling with a firearm stock;

a threaded longitudinal bore distal from the platform;

a web extending from the platform; and distal from the platform and projecting from the web in a transverse direction, at least one flange slidingly engaged within the channel; and a threaded shaft provided to the threaded longitudinal bore and rotatable relative thereto to slide the flange within the channel.

12. The firearm rest as set forth in claim 11, wherein the at least one flange engages the channel in a sliding T-slot joint.

13. The firearm rest as set forth in claim 11, further comprising a plate configured for coupling with the front of the rider to prohibit translation of the threaded shaft relative to the rider.

14. The firearm rest as set forth in claim 11, further comprising a polygonal retainer configured for coupling with the front of the rider and having a cut-out through at least one side.

15. The firearm rest as set forth in claim 14, further comprising a knob provided to a first end of the threaded shaft and having a groove configured for mating with the retainer.

16. The firearm rest as set forth in claim 11, wherein the mount is configured to cradle the firearm stock with a curvature defined by a radius rotated about an axis parallel with the threaded longitudinal bore.

17. The firearm rest as set forth in claim 11, wherein an angle measured between the base and the front is oblique.

18. The firearm rest as set forth in claim 11, wherein a sum of an angle measured between the top and the base and an angle measured between the base and the front is 90 degrees or less.

19. The firearm rest as set forth in claim 11, wherein rotating the threaded shaft in a first direction causes the threaded shaft to advance within the threaded longitudinal bore and the rider to slide along the mount in a first direction while rotating the knob in a second, opposite direction causes the threaded shaft to withdraw from the threaded longitudinal bore and the rider to slide in a second, opposite direction along the mount.

20. The firearm rest as set forth in claim 11, wherein the threaded shaft is further configured to advance the rider along the mount.

* * * * *